United States Patent [19]

Cowley et al.

[11] 4,345,962

[45] Aug. 24, 1982

[54] CONTROL IN APPLICATION OF PULP INSULATION TO ELECTRICAL CONDUCTORS

[75] Inventors: William E. Cowley, Ottawa; Michael A. Shannon, Glen Burnie; Victor L. LeNir, Montreal, all of Canada

[73] Assignee: Northern Telecom Limited, Montreal, Canada

[21] Appl. No.: 277,327

[22] Filed: Jun. 25, 1981

[51] Int. Cl.[3] ..... H01B 3/48

[52] U.S. Cl. ..... 156/356; 118/672; 156/51; 156/64; 156/359; 156/360; 156/578; 162/106

[58] Field of Search ..... 156/64, 378, 356, 360, 156/51, 279, 359; 427/118, 120; 118/672, 690; 162/106

[56] References Cited

U.S. PATENT DOCUMENTS 3,779,843 12/1973 Knapp ..... 156/64

4,218,285 8/1980 Durr et al. ..... 427/120 X

*Primary Examiner*—David A. Simmons

*Attorney, Agent, or Firm*—R. J. Austin

[57] ABSTRACT

Apparatus for applying pulp to a conductor with a control to operate an adjusting means to vary the amount of pulp fibre in a pulp bath dependent upon signals received corresponding to weight of pulp applied to the conductor whereby the weight is controlled within preset limits. Another requirement is an oven with at least two zones and a moisture measuring and diameter measuring means for pulp issuing from the oven, the latter means controlling the oven zone temperatures to provide a controlled degree of pulp expansion during flash evaporation and a controlled moisture retention in the dried pulp.

7 Claims, 3 Drawing Figures

CONTROL IN APPLICATION OF PULP INSULATION TO ELECTRICAL CONDUCTORS

This invention relates to the control in application of pulp insulation to electrical conductors.

In the manufacture of cable, fibrous insulation is sometimes used upon the electrical conductors. This insulation is added in the form of pulp which is applied to the conductors by passing them through a pulp bath so that pulp is drawn out of the bath by the conductors as an unseamed covering layer.

In the manufacture of each cable type and size, it is necessary to comply with certain manufacturing specifications, i.e. mutual capacitance and dielectric strength. These factors are determined in part by the outside diameter of the pulp and its density. Quality control of the pulp is therefore necessary. For such control, representative samples of the insulation are taken and tests are performed to determine moisture content in the pulp, the diameter of the pulp insulation and its fibre content.

The present procedure of sample taking and testing is manual and is a lengthy one. In consequence, with such a long time cycle of testing, it is difficult to hold working parameters within their desired limits of operation because of the delay sometimes found between a variation occurring between a parameter and its desired amount and any steps taken to correct it. Thus the present control procedure is unsatisfactory. This situation is worsened as two or more parameters have to be controlled. As adjustments to insulating apparatus are manual, any correctional steps taken in respect of one parameter is likely to cause variation between another parameter and its desired value, such variation is not readily discernible until a subsequent representative sample is taken and tested.

The present invention concerns apparatus which will provide pulp insulation on conductors while enabling an improved control on moistue content and diameter of the dried pulp insulation.

Accordingly, the present invention provides apparatus for pulp insulating a plurality of conductors comprising a pulp bath for simultaneous passage of the conductors along side-by-side paths, weight measuring means to measure the weight of wet pulp applied to the conductors, means to adjust the amount of pulp fibre entering the bath per unit time, control means, actuable by signals received from the weight measuring means and corresponding to the actual weight of pulp per unit length, to operate the pulp fibre amount adjusting means to change the amount of the pulp fibre in the bath and thus to bring the weight within preset limits, an oven for drying the pulp, said oven being composed of at least two zones, an upstream zone and a downstream zone, said zones each having an adjustable drying temperature setting, a moisture measuring means and a diameter measuring means downstream of the oven to measure moisture retention and average final diameter of the pulp on the conductors, the diameter measuring means being associated with the adjustable temperature setting of the upstream zone of the oven to influence that setting to control the rate of flash evaporation in the upstream zone and thus the degree of expansion of the pulp during flash evaporation; and the moisture measuring means being associated with the adjustable temperature setting of the downstream zone of the oven to control the rate of drying in the downstream zone to provide a desired moisture retention in the pulp upon the insulated conductors emerging from the oven.

The amount of pulp fibre entering the bath may be conveniently adjusted by adjusting a pulp flow valve into the bath whereby the actual flow rate of the pulp is adjusted. Alternatively, the consistency of the pulp is changed, but this is more difficult to control accurately.

One embodiment of the invention will now be described, by way of example, with reference to the accompanying drawings in which.

Figure 1:
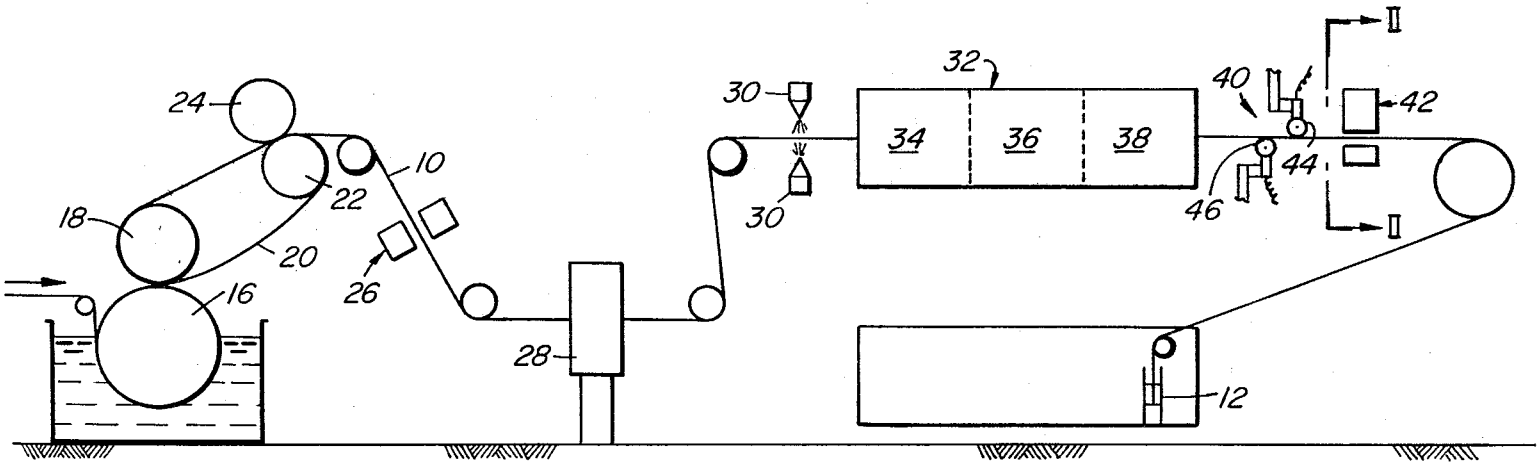
FIG. 1 is a side elevational diagrammatic representation of apparatus for applying pulp insulation to electrical conductor.

As shown in FIG. 1, a plurality of electrical conductors 10, e.g. 60, are drawn by take-up reels 12, side-by-side through a fibre pulp applicator vat and pass around rolls 16, 18 to submerge the conductors and draw off a continuous coating of pulp onto the conductors as they leave the bath. In FIG. 1, only one conductor and take-up reel is shown.

The pulp covered conductors are then drawn upon endless conveyor 20, passing around roll 18 and forming roll 22 which cooperates with a forming roll 24 to press the pulp ribbon into a thin strip with the conductor embedded in it and to remove water from the pulp. From the rolls the shaped pulp surrounded conductors are passed through weight testing apparatus 26 which is constructed and operates in the manner described in U.S. patent application Ser. No. 277,328, entitled "Conductor Insulation Weight Testing" in the names of W. E. Cowley and M. A. Shannon and filed concurrently with this present application.

The pulp covered conductors then proceed through rotating polishers 28 to form the pulp ribbon into a cylinder concentric with the conductor, water sprayers 30, drying oven 32, having three drying zones 34, 36 and 38, a pulp moisture measuring device 40 and a diameter measuring device 42 before reaching the take-up reels 12.

By the use of the moisture measuring device 40 and diameter measuring device 42 and associated control apparatus now to be described, the pulp on each conductor is maintained at an outside diameter which is within preset limits and which, together with the weight measuring apparatus 26, ensures that a controlled finished density of pulp is obtained whereby the mutual capacitance properties between two pulp insulated conductor are maintained at a desired value within preset limits.

The moisture measuring device 40 is constructed similarly to moisture testing apparatus described in copending U.S. patent application Ser. No. 083,113, entitled "On Line Moisture Detection Apparatus" filed Oct. 9, 1979, now U.S. Pat. No. 4,309,654 in the names of M. A. Shannon and W. E. Cowley and will not be described in detail here. For purposes of this application, it will suffice to say that it comprises upper and lower pulleys 44 and 46 which contact all of the conductors as they pass through. The two pulleys are electrically insulated from their mounting frame (not shown), and the upper pulley 44 is disposed downstream of lower pulley 46. A first voltage source is connected to the upper pulley to provide a first voltage divider as described in said copending application. A second voltage divider is provided by connecting a second voltage to the lower pulley 46.

Figure 3:
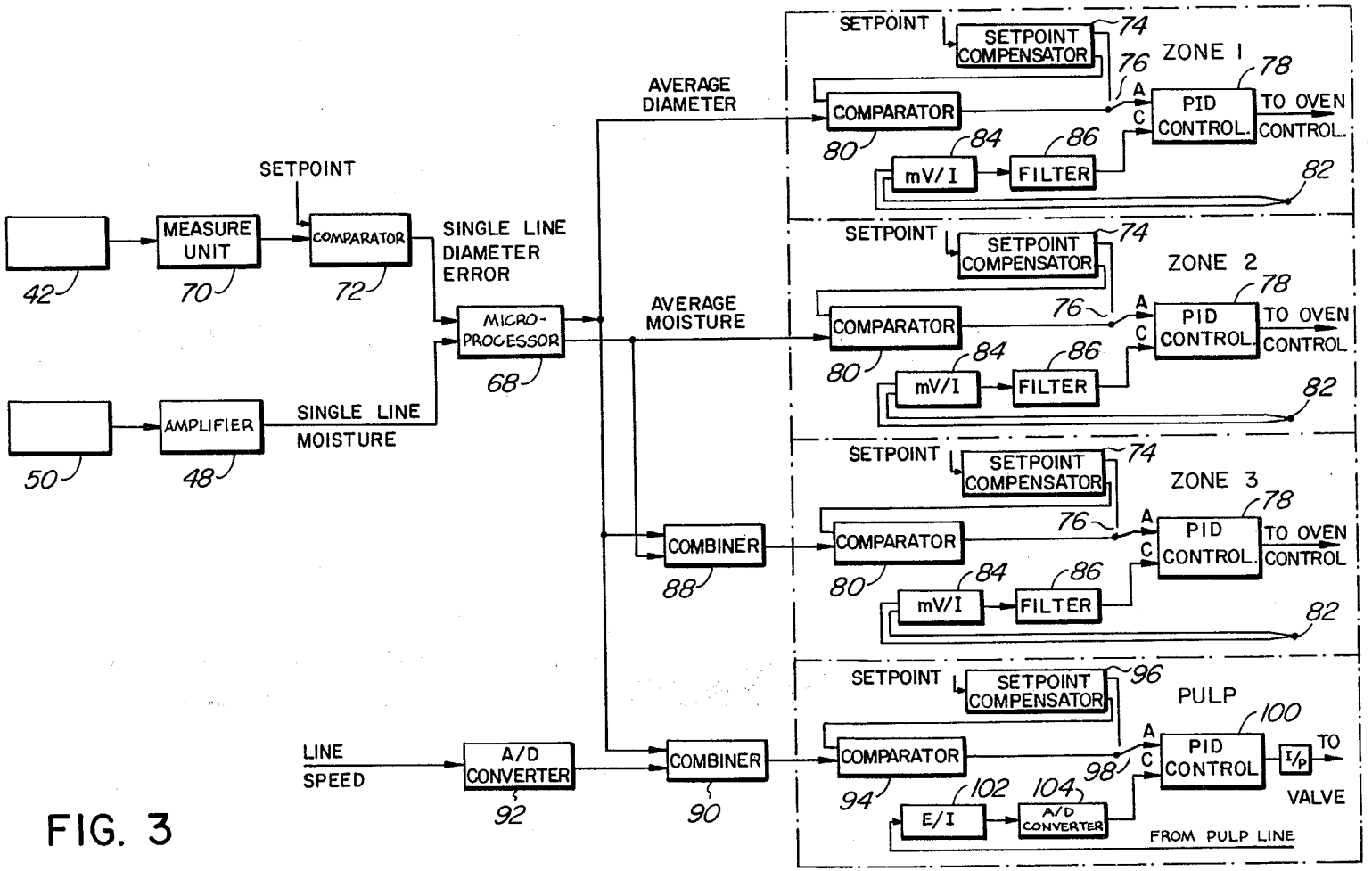
FIG. 3 is a control block diagram.

The signals from the two voltage dividers are fed to two high impedance amplifiers (not shown), and from there to a differential amplifier 48 (FIG. 3).

Figure 2:
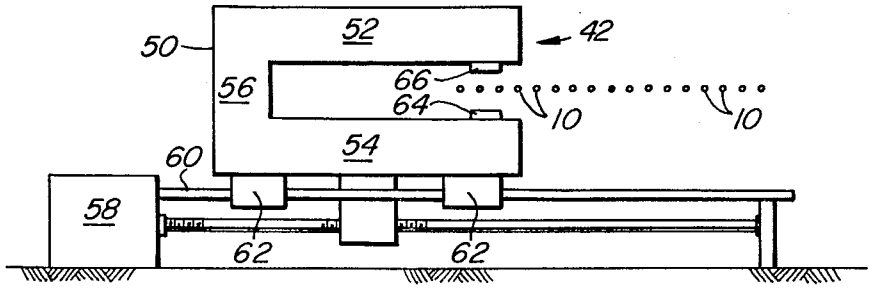
FIG. 2 is a cross-sectional view taken along line II—II in FIG. 1 showing pulp covered core being passed through a diameter measuring device.

The diameter measuring device 42 (FIG. 2) comprises a radiation scanning device 50 having two arms 52, 54 for movement above and below the pass line of the conductors, the arms being joined at one end by a vertical base 56. A reversible drive motor 58 is connected to the device 50 by a drive screw 60, and sliding guides 62 hold the device 50 correctly in position as it travels laterally of the conductors.

The device 50 comprises a laser radiation emitter 64 mounted at the free end of the lower arm 54, the emitter being directed across the pass line. A radiation detector 66 is mounted, in line with the emitter, at the free end of the upper arm 52.

In use, the device 50 moves from left to right intermittently across the pass line and stops each time the emitter 64 and detector 66 are disposed correctly in position on each side of a conductor. After the device 50 has been in position sufficiently long, e.g. about 8 seconds, for the detector to have obtained a light signal from the emitter which corresponds to the diameter of the conductor, the motor 58 is energized by a microprocessor 68 (FIG. 3) to move the device 50 to bring the emitter and detector into positions above the next succeeding conductor.

As shown by the control block diagram in FIG. 3, signals from the measuring device 42 are digital count signals which are sent to a measuring unit 70. These signals which correspond to the diameter of each insulated conductor are sent as digital signals to a digital-/analog comparator 72 which compress the digital value with a digital datam value which corresponds to the actual desired diameter of the insulated signal. This comparison produces a difference measurement which is digital and which is converted to an analog voltage. The analog voltage is then transmitted to the microprocessor. The microprocessor then averages the received analog voltages which correspond to the diameter differences and sends an analog signal corresponding to the average pulp diameter to a control for temperature for each of zones 1 and 3 in the oven and for the pulp consistency.

The three zones in the oven are controlled in similar fashion and one zone only, zone 1 will be described in detail. The same reference numbers will be used on similar parts in the other two zones.

In zone 1, a manual temperature setting is possible with a temperature set point compensator 74 to control the temperature of the zone through a changeover switch 76 and through a proportional integral differential (PID) standard controller 78 to the oven temperature control. The oven temperature is maintained at this manually set temperature until an output control signal is received at the control.

The analog signals from the microprocessor 68 are received at a comparator 80 where they are compared with digital signals corresponding to the preset manual temperature setting. From these signals the comparator prepares output compared digital signals and these are transmitted through the switch, in its changover position in FIG. 3, to the controller 78. At this position, the compared digital signal is compared with a digital signal received from a thermocouple 82 within the oven and corresponding to the actual oven zone temperature. The thermocouple transmits a millivoltage, the value of which corresponds to the zone temperature, and this millivoltage is changed into a current in a millivolt/current converter 84 and transmitted as a corresponding analog signal to an analog/digital filter 86 which then sends a corresponding digital signal to the controller 78. The output control signal from the controller is composed of average conductor diameter and oven temperature signals and this output control signal is transmitted to the temperature control to change the oven temperature in the desired fashion.

The object of the above exercise is, of course, to give the final desired diameter to the dried insulated conductor emerging from the oven. At the time of entering the oven, the insulation is wet pulp. If treated to high enough temperatures and with sudden application, for instance as in zone 1 of the oven, the moisture in the pulp will vaporize sufficiently quickly to cause the pulp to expand under the forces involved during flash evaporation. For any given amount of moisture in the pulp, its degree of expansion will depend upon the oven temperature. Hence, if the analog signal to the comparator 80 represents an average diameter below that desired for the insulated conductors, then the output control signal from the controller is affected by this and the temperature control in zone 1 is actuated to cause the temperature in the oven to rise. This effects faster evaporation of the moisture and thus a more explosive removal of the vapour to cause further expansion of the pulp, thereby increasing its diameter. On the other hand, if the average diameters of the insulated conductors are higher than that required, then the analog signals to the comparator 80 and output control signals from the controller reflect this and the oven zone 1 temperature is caused to drop controllably to cause less expansion of pulp during flash evaporation.

After the pulp expansion has taken place in zone 1 of the oven, the other zones 2 and 3 operate to remove the remainder of the moisture down to a fixed moisture percentage as the dried insulated conductor leaves the oven.

After the pulp expansion has taken place in zone 1 of the oven, the other zones 2 and 3 operate to remove the remainder of the moisture down to a fixed moisture percentage as the dried insulated conductor leaves the oven.

As is shown by FIG. 3, the analog signals for average pulp diameter are transmitted also to the control of zone 3 where the temperature is controlled in a similar manner to that described for zone 1. It is found that when zone 1 temperature rises, this effects more rapid removal of moisture and consequently, for a given amount of starting moisture, the temperature of zones 2 and 3 should be lowered to result in a fixed moisture content as the conductor leaves the oven. Conversely, dropping of the temperature in zone 1 to give the desired final diameter should result in the temperature in zones 2 and 3 being raised under these same moisture conditions.

However, as the moisture may vary in the dried insulation, this must also have an effect upon the temperature in zones 2 and 3. Hence, before the analog signals for averaged diameter are received by the comparator 80 in zone 3, they are combined with an averaged moisture signal in a combiner 88 to give an output combined signal. The averaged moisture signal is derived from the signals received by the microprocessor 68 from the differential amplifier 48. Hence, if after drying, the moisture content in the pulp is above a desired value, this will result in the temperature of zone 3 being slightly higher than it would be if it depended upon pulp diameter alone.

The temperature in zone 2 is controlled solely by the moisture content of the dried insulation averaged over the 60 conductors.

The other factor affecting diameter of the pulp is the rate of flow of pulp fibre into the pulp bath 14. In this embodiment, the consistency of the pulp fibres in water is controlled upstream so that the rate of flow of pulp fibre into the bath is adjusted as required by adjusting the flow rate of the pulp into the bath. The main control of the apparatus is the weight testing apparatus 26 which serves to control the pulp flow rate into the bath to result, within limits, in a predetermined weight per unit length of pulp fibres as described in the aforementioned specification entitled "Conductor Insulation Weight Testing". While the apparatus 26 provides main control, the diameter measuring device provides a finer control for the rate of flow of pulp fibre. For this control, the analog signals corresponding to the average diameter are also fed to a combiner 90 in a pulp control unit. These analog signals are converted to digital signals in the combiner and are combined there with digital signals corresponding to the line speed of the conductors and as received from an analog to digital converter 92. The resultant output combined signal is then transmitted to a comparator 94 where it is compared with a signal received from a set point compensator 96 which has been manually preset to control the degree of opening of a pulp valve to the bath 14 through a changeover switch 98. When the signals are received by the comparator 94 from combiner 90 and compensator 96, and with the changeover switch in the position shown in FIG. 3, an output compared digital signal is sent from comparator 94 to a PID controller 100. The controller operates upon the position of the pulp valve to control the pulp flow rate into the bath, the flow rate being measured by a magnetic flow transmitter (not shown) which sends signals to a voltage to current converter 102. These signals are then converted to digital in an analog/digital converter 104 before proceeding to the controller 100. An output control signal of average diameter and line speed then passes to the pulp control mechanism to open or close the valve to change the pulp flow rate and thus to alter the final average diameter accordingly.

In use, as an initial step, the pulp flow rate is adjusted by the weight testing apparatus 26. After drying in the oven, the outside diameter of the insulated conductors are measured by the measuring device 42 and the analog signal for average diameter is transmitted to the comparator 80 of oven zone 1 and after being converted to a digital signal and compared with the signal from the setpoint compensator and then the signal from the thermocouple 82, the output control signal is sent from the controller to change the oven zone 1 temperature to obtain the required diameter. The average diameter analog signal is also transmitted to the combiner of zone 3 where it is combined with the averaged analog moisture signal and passed to the comparator of zone 3. The signal is treated in the same way in the control of zone 3 as that described for zone 1. The output control signal controls the zone 3 temperature as required to remove the moisture remaining at zone 3 and bring the moisture content of the dried conductor insulation down to its desired low level of perhaps 3% to 8%. As already discussed, the oven temperature of zone 3 is largely influenced by the temperature in zone 1, but if the moisture content of the dried conductor is too high or too low, then the average analog moisture signal in combination with the average diameter analog signal influences the zone 3 temperature in the appropriate direction to result in the desired moisture content of the dried conductor.

The zone 2 temperature is influenced solely by the average analog moisture signal in the manner already described for zones 1 and 3, and adjustment of temperature in zone 2 assists zone 3 in the removal of the required amount of moisture.

The final adjustment is a fine tuning adjustment of the pulp flow rate by further adjustment of the pulp valve through the controller 100. This adjustment, as it is minor, should have an insignificant effect on the more general adjustment provided by the weight testing device.

As may be seen from the above, the apparatus described controls the average diameter and moisture content of the dried conductor within preset limits. In view of the fact that the weight of the pulp is also controlled as it is applied to the conductors, this results in a substantially constant density of the dried product whereby the electrical properties, e.g. the mutual and in-line capacitance and inductance are accurately maintained between preset limits.

What is claimed is:

1. Apparatus for pulp insulating a plurality of conductors comprising:

a pulp bath for simultaneous passage of the conductors along side-by-side paths;

weight measuring means to measure the weight of wet pulp applied to the conductors;

means to adjust the amount of pulp fibre entering the bath per unit time;

control means, actuable by signals received from the weight measuring means and corresponding to the actual weight of pulp per unit length, to operate the pulp fibre amount adjusting means to change the amount of the pulp fibre in the bath and thus to bring the weight within preset limits;

an oven for drying the pulp, said oven being composed of at least two zones, an upstream zone and a downstream zone, said zones each having an adjustable drying temperature setting;

a moisture measuring means and a diameter measuring means downstream of the oven to measure moisture retention and average final diameter of the pulp on the conductors;

the diameter measuring means being associated with the adjustable temperature setting of the upstream zone of the oven to influence that setting to control the rate of flash evaporation in the upstream zone and thus the degree of expansion of the pulp during flash evaporation; and the moisture measuring means being associated with the adjustable temperature setting of the downstream zone of the oven to control the rate of drying in the downstream zone to provide a desired moisture retention in the pulp upon the insulated conductors emerging from the oven.

2. Apparatus according to claim 1, wherein the diameter measuring means is also associated with the temperature setting of the downstream zone of the oven, a combining means being provided and connected to combine input signals received from the diameter measuring means and from the moisture measuring means to provide an output combined signal which is influenced by the input signals and for control of the temperature setting of the downstream zone.

3. Apparatus according to claim 2, wherein the oven has an intermediate zone between the upstream and downstream zones, said intermediate zone having an adjustable drying temperature setting, the moisture measuring means being associated with the adjustable temperature setting of the intermediate zone, to influence that setting to desirably affect the rate of evaporation of moisture in the intermediate zone.

4. Apparatus according to claim 2 provided with a means for measuring line speed and another combining means connected to combine signals received from the diameter measuring means and from the moisture measuring means to provide an output combined signal which is influenced by the input signals to adjust the pulp valve setting as required towards achieving a desired diameter of the insulation on each conductor and its moisture content consistent with a weight of pulp as applied to the conductors and as controlled by the weight measuring means in conjunction with the control means.

5. Apparatus according to claim 1, wherein the upstream zone of the oven has a manual temperature setting to automatically control the temperature of said zone, a comparator provided to compare a signal corresponding to the average diameter of the pulp on the conductors and a signal corresponding to the manually set temperature and to give an output compared signal, a controller means to read the actual temperature of the upstream zone and to transmit a signal to the controller corresponding to said actual temperature, and the controller connected to the comparitor to receive the output compared signal from the comparator and to compare it with the signal corresponding to the actual temperature to give an output control signal to adjust the temperature setting of the upstream zone as required to control the rate of flash evaporation.

6. Apparatus according to claim 2, wherein the downstream zone has a manual temperature setting to automatically control the temperature of said zone, a comparator provided to compare the output combined signal from the combining means and a signal corresponding to the manually set temperature and to give an output compared signal, a differentiator, means to read the actual temperature of the downstream zone and to transmit a signal to the differentiator corresponding to said actual temperature, and the differentiator connected to the comparator to receive the output compared signal from the comparator and to compare it with the signal corresponding to the actual temperature to give an output control signal to adjust the temperature setting of the downstream zone as required to control the rate of drying.

7. Apparatus according to claim 1, wherein the diameter measuring means comprises a scanning device movable across the paths of the conductors, said scanning device having a signal emitter and a signal receiver disposed on opposite sides of said paths to transmit signals across the paths and receive signals so transmitted for each conductor in turn, received signals corresponding to the diameter of an associated conductor, a comparator to compare the received signals with a datum indicative of the desired diameter of each conductor and to give an output compared signal, and means to store and average said compared signals to provide an output averaged signal to influence the setting of the upstream zone.

* * * * *